United States Patent [19]

Cloutier

[11] Patent Number: 4,887,658

[45] Date of Patent: Dec. 19, 1989

[54] FLEXIBLE COUNTERWEIGHT SYSTEM FOR OVERHEAD DOORS AND LIKE INSTALLATIONS HAVING REMOVABLE WEIGHTS

[76] Inventor: Hermel R. Cloutier, 1095 Mississauga Street West, Orillia, Ontario, Canada

[21] Appl. No.: 214,288

[22] Filed: Jul. 1, 1988

[51] Int. Cl.[4] ..... E05F 11/54

[52] U.S. Cl. ..... 160/190; 160/201

[58] Field of Search ..... 160/189, 190, 192, 193, 160/201

[56] References Cited

U.S. PATENT DOCUMENTS 1,469,542 10/1923 Storms ..... 160/190
1,603,379 10/1926 Dautrick .
3,079,989 3/1963 Fentiman ..... 160/189
3,094,163 6/1963 Herber ..... 160/190

*Primary Examiner*—Ramon S. Britts
*Assistant Examiner*—David G. Kolman
*Attorney, Agent, or Firm*—Fish & Richardson

[57] ABSTRACT

A counterweight system for an overhead door or like installation includes an elongate flexible belt having a series of pockets to receive weights, the belt being suspended at the side of the door from a cable that passes over a pulley and is attached to the lower end of the door, the lower end of the belt being connected to the door frame about halfway in the height of the door such that when the door moves in the opening direction the weights are successively suspended from the fixed attachment point so that the opening force applied to the door accurately counterbalances the effective weight of the door at all points in the opening movement.

22 Claims, 4 Drawing Sheets

FLEXIBLE COUNTERWEIGHT SYSTEM FOR OVERHEAD DOORS AND LIKE INSTALLATIONS HAVING REMOVABLE WEIGHTS

FIELD OF THE INVENTION

This invention relates to a new or improved counterweight system for use in overhead doors and like installations, and to such installations incorporating the improved counterweight system.

The invention is applicable to doors and the like that have a series of horizontal sections guided to move in vertically arranged tracks at opposite vertical edges of the door. It is equally applicable to similar installations such as roller shutters or blinds, and accordingly, although for convenience for language the invention will be discussed in relation to door installations, it is to be clearly understood that as used herein the term "door" encompasses all equivalent structures specifically including roller shutters and blinds.

DESCRIPTION OF THE PRIOR ART

Sectional overhead doors are used in numerous industrial commercial and domestic applications, and perhaps most commonly as a door for a domestic garage.

Such doors are usually guided on tracks that extend vertically at opposite edges of the door, the upper portions of the tracks being curved to extend horizontally rearwardly away from the door. To facilitate opening of such doors they commonly include spring-actuated counterbalance systems. These systems are of two general types, one employing coiled tension springs vertically oriented at each side of the door, and the other employing a torsion spring arrangement horizontally oriented above the door opening, both systems being connected to the door itself through an arrangement of cables passing over pulleys. Both of these common systems are troublesome and expensive to install, are prone to malfunction, represent a safety hazard, and at best provide only an approximation of a counterbalance force required throughout the range of opening movement of the door.

SUMMARY OF THE INVENTION

The present invention provides a counterweight system for doors and like installations, the door having a series of horizontal sections that are guided to move in tracks arranged at opposite vertical edges of the door, the tracks having curved portions above the doorway that extend away from the plane of the doorway and support the weight of the horizontal door sections when these successively pass into the curved track portions as the door is opened, said counterweight system comprising a flexible elongate carrier and a series of weights adapted to be secured to the carrier at selected close intervals therealong and over a length that corresponds to approximately one-half of the opening height of the door, said carrier being adapted for connection at one end to cable means that is connected to the door near the lower end thereof, and to be vertically suspended from said one end adjacent the door, the opposite end portion of said carrier being connected to a fixed point of attachment adjacent said door such that when the door is in its closed position, the sum of all of said weights is applied as an equivalent force acting on the door in the opening direction, but when said door is moved towards its open position, the carrier moves progressively downwardly under the force of gravity, and starting from its lower end, the load of said weights is increasingly supported by said fixed point of attachment, thus reducing the opening force applied to said door as the horizontal door sections successively pass into the curved track portions; and a casing adapted for mounting adjacent the door to define a substantially enclosed pathway around said carrier.

With this system it is possible to match very closely the ideal counterweight force throughout the entire range of door opening movement.

Preferably the carrier is in the form of a belt having a series of closely spaced pockets extending therealong to receive the weights. The weights may conveniently be in the form of short rods of dense material such as cast iron or lead. The belt is conveniently fabricated as two superimposed layers of flexible synthetic fabric material such as rayon, with transverse lines of stitching arranged therealong to define the weight-receiving pockets. To retain the weights in the pockets, the end parts of the weights can be made somewhat enlarged, and slightly larger than the dimension of the pocket. Alternatively, a tubular sleeve can be provide to pass over the belt with the weights installed therein, the sleeve thus preventing displacement of the weights from their pockets.

The carrier belt is conveniently formed with an extended tail section having a series of eyelets spaced therealong, any one of which can be connected to the fixed point of attachment depending upon the requirements of the particular installation involved. Specifically, although in domestic garage doors installations the top section of the door starts to move out of the vertical towards the horizontal in the guiding tracks almost immediately upon commencement of the door opening, in some installations the tracks are so arranged that the door must move a substantial distance in the vertical direction before the tracks curve towards the horizontal. This configuration is easily accommodated by the disclosed carrier belt since all that is necessary is that the point of attachment of the tail be spaced a corresponding distance below the lowermost weight, so that throughout the range of movement when the door remains vertical, the entire load of the counterweight as applied to the door without being diminished.

In an alternative configuration the carrier is provided as one or a pair of cords that are threaded through apertures in the weights. This arrangement may include spacers attached to the cords to maintain the weights at a desired spaced, and may also include a tail formed with eyelets spaced therealong.

The invention also provides a sectional door installation comprising: a door that is horizontally divided into a plurality of pivotally interconnected sections that have opposite ends guided in a pair of upright tracks positioned at opposite margins of a doorway, upper portions of said tracks being curved to extend horizontally away from said doorway such that when the door is moved from the closed position to the open position said sections follow in succession along the path of said tracks, said installation including a counterweight system comprising a flexible elongate carrier having a series of weights spaced along its length, the carrier having an upper end that is coupled to the door and a lower end connected to fixed attachment point, the arrangement being such that when the door is in the closed position, substantially the entire weight of said series of weights is applied as a force urging the door in the opening direction, whereas when the door is moved in the opening direction said carrier moves downwardly under the force of gravity so that said weights are successively supported from the lower fixed attachment point and thus cease to apply any force to the door.

Preferably there is a carrier provided at each side of the door, and a hollow casing is provided to form an enclosed channel within which the vertical movement of the carrier and weights takes place. The provision of such an enclosed channel ensures that the installation is extremely safe in its operation since there is no possibility for an individual to inadvertently come into contact with the operating counterweight mechanism and thus be exposed to the risk of injury.

Furthermore the installation is extremely simple and convenient since the pulleys guiding the cables connecting the weighted carrier and the door can simply be mounted directly at the top end of the casing.

BRIEF DESCRIPTION OF THE DRAWINGS

The invention will further be described, by way of example only, with reference to the preferred embodiments illustrated in the attached drawings wherein.

DESCRIPTION OF THE PREFERRED EMBODIMENTS

Figure 1:
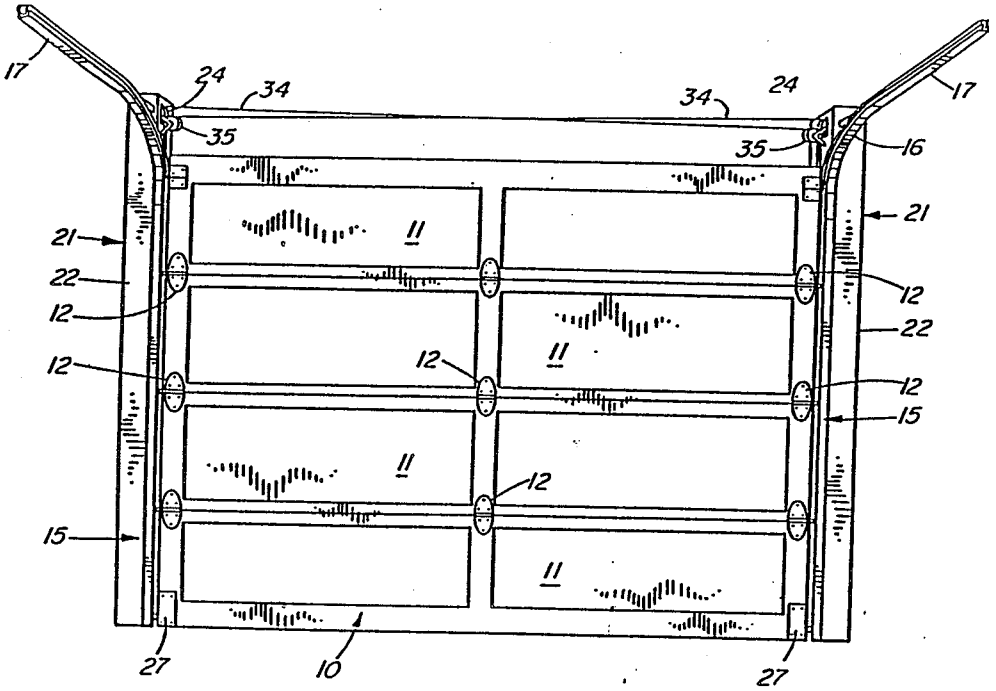
FIG. 1 is a perspective view from the inside of a sectional overhead shown in the closed position.

By way of illustration, but not of limitation, the invention will be described in relation to preferred embodiments as shown in the drawings as comprising overhead doors of the type used for domestic garages. FIG. 1 shows such a door 10 which typically will have overall dimensions of approximately 9 feet in width by 7 feet in height and be horizontally divided into a series of pivotally interconnected sections 11. These sections 11 may be fabricated in any suitable material, and typically will comprise pressed steel or aluminum panels interconnected by spaced hinges 12, the marginal ones of which have laterally projecting pins 13 that carry rollers 14 guided for movement in a vertically arranged track 15 at each edge of the door, the upper portion of each track having a curved transition 16 leading to a horizontal portion 17 extending away from the plane of the door 10. As is well understood, when the door is opened by being raised from its bottom edge, the upper sections 11 are guided by their rollers to move upwardly from the vertical orientation and into a horizontal orientation as the door is raised.

Figure 2:
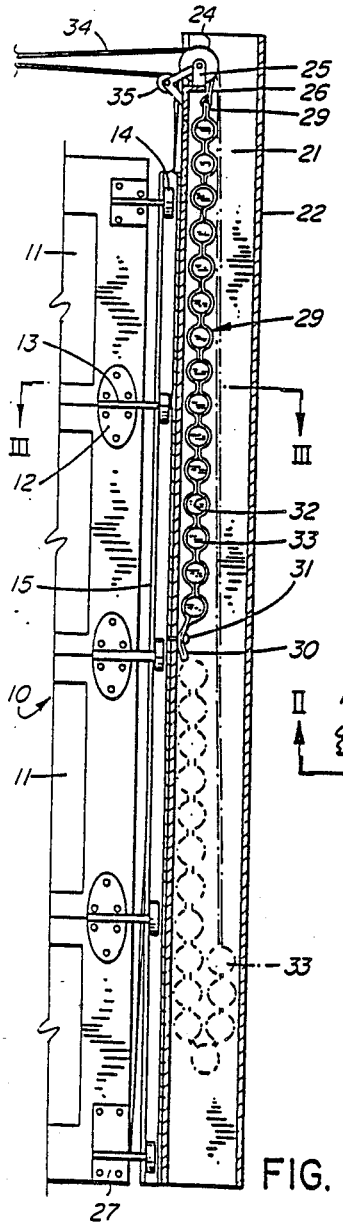
FIG. 2 is an enlarged fragmentary vertical section through one side of the door installation and taken generally on the line II—II in FIG. 3.
Figure 3:
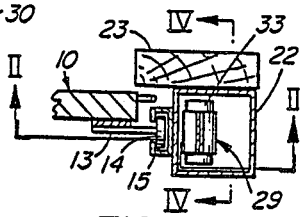
FIG. 3 is a horizontal cross-section taken on the line III—III in FIG. 2.

To facilitate opening movement of the door, a counterweight system 21 as more fully illustrated in FIG. 2 is provided and comprises a hollow vertically arranged casing 22 attached to the door frame 23 at each side of the door and also forming an attachment for the vertical portion of the track 15. At the upper end of the casing is mounted a pulley 24 rotatable about a horizontal axis carried in a bracket 25 mounted on the casing 22 in a manner such that it can swivel about a vertical axis. A flexible steel cable 26 is attached at one end to a bottom fixture 27 at the adjacent lower edge of the door and extends from there vertically upwards alongside the track 15 to pass over the pulley 24, the other end of this cable being attached to the upper end 28 of a flexible carrier belt 29 which hangs downwardly within the hollow casing 22 and is attached at its lower end 30 to a mounting stud 31 fixed to the casing 22 about midway in its height.

Figure 4:
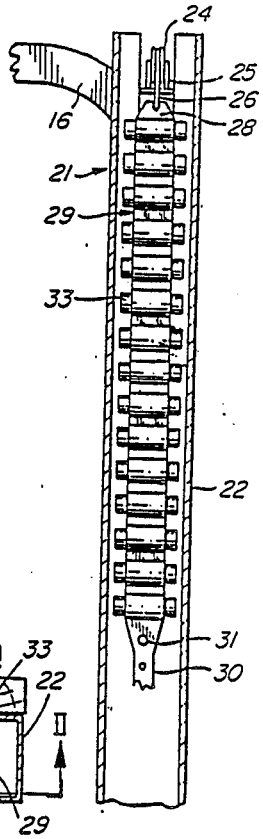
FIG. 4 is a fragmentary vertical section taken on the line IV—IV in FIG. 3.

The carrier belt 29 is formed as a flexible element from two overlying layers of synthetic fabric such as rayon or nylon, these layers being interconnected transversely as by rows of stitching to define therebetween spaced pockets 32 the sides of which can be separated to form openings to receive one of a series of weights 33. The weights 33 are formed from any suitable high density material such as lead, steel, cast iron etc. and are as shown in FIGS. 2 and 4 carried in closely spaced arrangement along the belt 29 between its upper and lower ends. As shown in FIGS. 2 and 4, with the door in the closed position, the entire weight of the carrier belt 29 is suspended from the cable 26 and thus applies a corresponding force to the bottom fixture 27 in the opening direction of the door. Conventional latching or locking means (not shown) retain the door in the closed position against this force.

When the door is unlatched it is free to move upwardly in the opening direction, such movement being assisted by the weight of the loaded carrier belt 29 which may be selected as desired to counterbalance all or substantially all of the weight of the door, so that the door can be moved upwardly with minimal effort.

As will be clear, as the door proceeds in the opening direction, the rollers 14 of the uppermost door section 11 will move into the curved track portion 16, thus pivoting the uppermost door section about its lower edge. As the opening movement proceeds, the weight of the uppermost section 11 is more and more supported by the curved track portion 16, and then the horizontal track portion 17 so that the counterbalance force required to act on the bottom fixtures 27 of the door is correspondingly reduced. The counterweight system disclosed effects this reduction in that as the door moves upwardly, the cable 26 moves over the pulley 24 so that the loaded carrier belt 29 moves downwardly. As the downwards movement progresses, the lower end 30 of the carrier belt 29 folds about the mounting stud 31 as the lowermost weights move downwardly, so that the carrier 29 then becomes progressively suspended from its lowermost end and the force applied by the weights to the cable 26 is progressively decreased, this decrease closely matching the effective weight of the door as supported at the bottom fixtures 27. Thus the door is accurately counterbalanced throughout its range of opening movement. For example the position shown in FIG. 2 in broken lines indicates that of the fifteen weights 33 eleven are supported from the stud 31, so that the force acting upon the cable 26 corresponds to the mass of three and part of a fourth of the weights 33. When the door is fully opened, then all of the weights 33 will be suspended from the stud 31 so that there will be no residual force in the cable 26. However the door will remain in the fully opened position, since any tendency for it to return to a partially closed position (as commonly occurs with spring counterbalanced overhead doors) would entail raising of the weights 33 from the lowermost end and would therefore be resisted by these weights.

As has been mentioned above, and is indicated in FIG. 1, there is a counterweight system 21 at each of the vertical edges of the door 10, and in each system, the weighted belt 29 is adapted to counterbalance approximately one-half of the overall weight of the door. To ensure that the door opening movement is smooth and reliable, a connection is formed between each weighted belt 29 and the bottom fixture 27 on the opposite side of the door. Thus, a second flexible cable 34 is connected to each of the bottom fixtures 27, extends upwardly vertically to a pulley 35 mounted on the casing 22, and then extends horizontally above the door opening to pass over the pulley 24 and be connected to the upper end of the opposite side carrier belt 29. The cross connection of the counterweight provided by these cables 34 ensure smooth opening of the door without any tendency for it to cant, tilt or jam. Furthermore there is an added safety feature in that should either of the main cables 26 be broken, the door will still be pulley counterbalanced in that the associated carrier belt 29 will still be attached to the second cable 34, and therefore its weight will still be fully available for counterbalancing the door 10.

Figure 5:
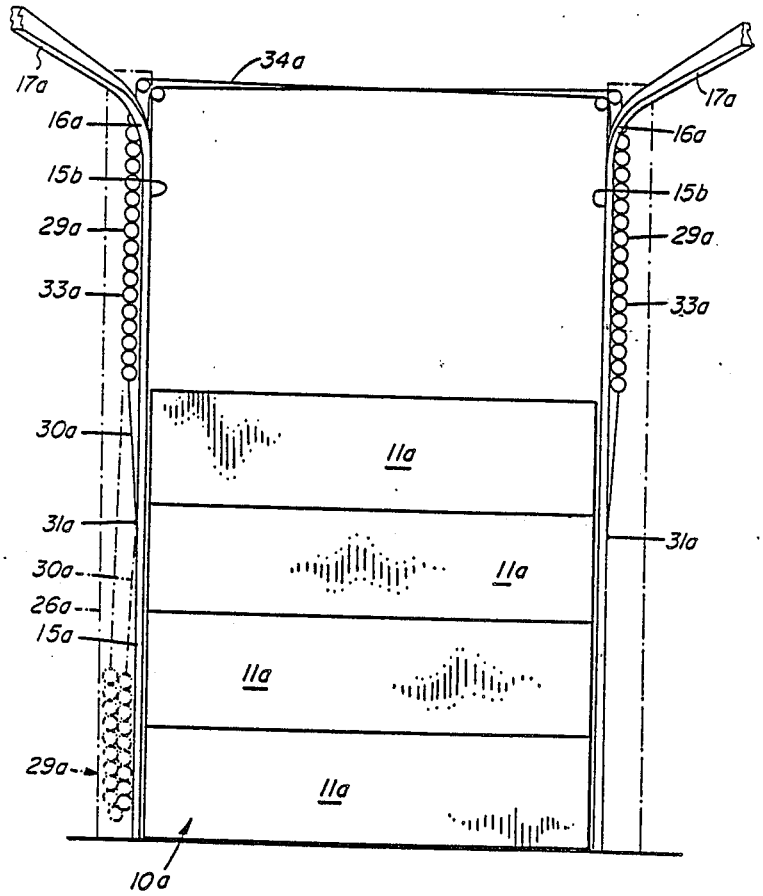
FIG. 5 is a view similar to FIG. 1 showing an alternative installation, in somewhat schematic form.

In some applications it may for various reasons be necessary to have the door guiding tracks extend vertically a significant distance above the doorway before they curve to the horizontal. Such doors are known as "high lift" doors, and may be required in installations where greater vertical clearance is required below the horizontal sections of the guide track. The counterweight system of the present invention is applicable to such installations without substantial modification. Such a high lift door installation is shown in FIG. 5 wherein the door 10*a* is formed as before of pivotally interconnected sections 11*a* guided at their ends for movement in tracks 15*a*, the door being shown in the closed position and fully closing the doorway. The tracks 15*a* have vertically extended portions 15*b* above the doorway and leading to the curved transition portions 16*a* and the horizontal portions 17*a*. Thus it will be appreciated that the door 10*a* must move vertically throughout a distance corresponding to the length of the extended portions 15*b* before entering the curved portions 16*a* of the tracks, and that throughout this range of movement, substantially the entire weight of the door has to be counterbalanced. The counterweight system of the present invention easily accommodates this situation and merely involves the provision of an extended lower end portion 30*a* on the carrier belt 29*a*, and the upwards displacement of the mounting stud 31*a* as shown in FIG. 5. The length of the tail 30*a* between the lowermost of the weights 33*a* and the stud 31*a* corresponds to about one-half of the height of the extended portions 15*b* of the track. Thus it will be seen that as the door 10*a* is moved in the opening direction, the entire weight of the carrier belts 29*a* will be available to counterbalance the weight of the door, and will not begin to diminish until the lowermost of the weights 33*a* has descended from the position shown in full lines in FIG. 5 to the position shown in broken lines, this being a distance equivalent to the height of the extended track sections 15*b*. As the door then continues to move in the opening direction, the weights 33*a* will successively be suspended from the studs 31*a* and will therefore no longer act upon the door.

In the fully opened position of the door, the carrier belts 29*a* will be in the positions shown in broken lines in the lower left-hand side of FIG. 5, i.e. with approximately one-half of the weights still suspended from the cable 26*a*, and therefore still providing a counterbalancing force on the door 10*a*. This is because in the fully open position of the door 10*a*, the lower two of the sections 11*a* will still be within the extended portions 15*b* of the track, and therefore will still require to be counterbalanced. As with the previous embodiment, there are transversely extending secondary cables 34*a* interconnecting the counterweight systems on the opposites sides of the door.

Figure 6:
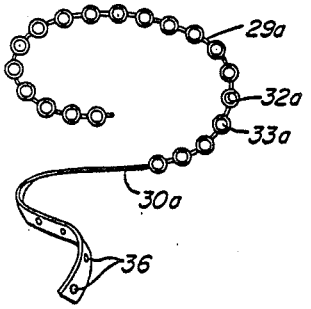
FIGS. 6 and 7 show alternative configurations of a carrier element of the counterweight system; and FIGS. *7a, 7b* and *7d* show details of the carrier of FIG. 7.

FIG. 6 illustrates a carrier belt 29*a* as used in the FIG. 5 embodiment, this being of a flexible fabrication and defining a series of pockets 32*a* receiving the weights 33*a*, there being a tail section 30*a* formed with a series of eyelets 36 spaced therealong. In a given installation, depending on the configuration of the door tracks, one or other of eyelets 36 can be attached to the mounting stud 31 to provide the desired counterbalancing characteristics.

Figure 7:
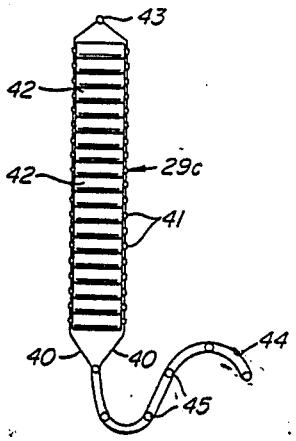
Figure 7A:
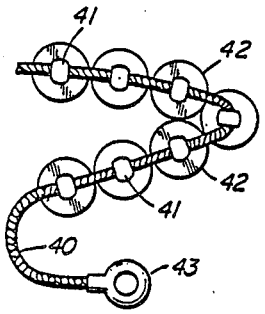
Figure 7B:
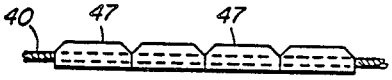
Figure 7C:
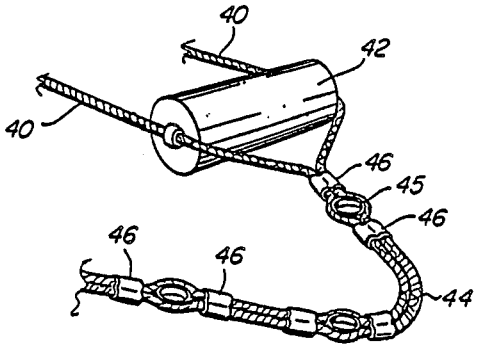

An alternative configuration of carrier belt 29*c* is shown in FIGS. 7, 7*a* and 7*c*. In this case the carrier belt is formed from a pair of flexible cords 40 that are threaded through lugs 41 at the opposite ends of a series of cylindrical weights 42, the cords being joined at their upper ends to form a top attachment 43, and at their lower ends to form a tail 44. As best shown in FIG. 7*c*, the tail 44 includes a series of spaced eyelets 45 in the form of metal rings about which the cords are secured in each case by a pair of crimped fasteners 46 arranged one on each side of the eyelet.

The weights of the carrier belt 29*c* may be in contacting relationship as shown in FIG. 7*a*, or else may be spaced apart as required to suit the opening characteristics of the door installation with which they are used. Where spacing of the weights is required, the cords 40 may be threaded through one or a plurality of spacers 47 positioned between the lugs 41 of adjacent weights 42. By proper selection of the magnitude or spacing of the weights 42, the counterbalancing characteristics of the system can be varied within very wide limits to match the requirements in virtually any conceivable application. Thus the weights need not all be of identical weight, nor need the spacing between them be uniform, but on the contrary these factors may be varied if required.

The counterbalancing system disclosed herein offers numerous advantages over systems hitherto available. The installation is particularly simple in most applications, and especially on domestic garage doors. For example the counterweight system would essentially be supplied in the form of two casings 22 provided with the guide rail 15 attached thereto, and with the carrier belt 29 in place arranged with its lower end attached to the stud 31 and its upper end temporarily attached to the upper end of the casing. Therefore all that is required is for the casing 22 to be mounted to the doorframe, the intermediate and upper track sections mounted and supported, the door installed, and the cables 26 and 34 threaded over their pulleys and attached at their ends to the bottom fixtures 27 and the belts 29. Thereafter the temporary attachment of the belts 29 to the upper end of the casing can be released and this system is then operational. This installation is clearly much simpler and faster than a conventional counterbalance system.

The counterbalance system is smooth and very easy to operate since it can match very closely the characteristics of the door. Particularly where electrically driven door openers are employed, the effort required is significantly reduced compared to conventional systems, and therefore requires a less powerful motor.

The system is less expensive than counterbalanced systems presently employed and is reliable in operation requiring minimal maintenance or repair. The system enables the garage door to stay open in the full height position in contrast to spring operated counterbalance systems wherein typically this is not possible. It can be used on standard, high lift, or vertical lift doors without any basic change in its structure. Furthermore, the counterbalance can be retro-fitted to existing door installations without any modification of the door.

I claim:

1. A counterweight system for doors and like installations, the door having a series of horizontal sections that are guided to move in tracks arranged at opposite vertical edges of the door, the tracks having curved portions above the doorway that extend away from the plane of the doorway and support the weight of the horizontal door sections when these successively pass into the curved track portions as the door is opened, said counterweight system comprising a flexible continuous elongate carrier and a series of weights supported by the carrier at selected close intervals therealong and over a length that corresponds to approximately one-half of the opening height of the door, said weights being spaced from each other by portions of the carrier such that the presence of the weights does not prevent flexure of the carrier, means for connecting said carrier at one end to the door near the lower end thereof, and pulley means for vertically suspending said carrier from said one end adjacent the door, the opposite end portions of said carrier being connectable to a fixed point of attachment adjacent said door such that when the door is in its closed position, the sum of all of said weights is applied as an equivalent force acting on the door in the opening direction, but when said door is moved towards its open position, the carrier moves progressively downwardly under the force of gravity, and starting from its lower end, is folded back upon itself so that the load of said weights is increasingly supported by said fixed point of attachment, thus reducing the opening force applied to said door as the horizontal door sections successively pass into the curved track portions; and a casing adapted for mounting adjacent the door to define a substantially enclosed pathway around said carrier, said carrier being comprised of at least one flexible member of unitary construction which extends from said pulley means to said point of fixed attachment.

2. A counterweight system according to claim 1 wherein the carrier is in the form of a belt having a series of pockets closely spaced therealong to receive said weights.

3. A counterweight system according to claim 1 wherein said weights extend over a length of the carrier that is about half the opening height of the door, the carrier having an unweighted extension at said opposite en portion thereof that is adapted for connection to the fixed point of attachment at a selected one of a number of different locations spaced along its length.

4. A counterweight system according to claim 3 wherein said locations are defined by a number of eyelets spaced along said extension.

5. A counterweight system according to claim 1, wherein said at least one flexible member of unitary construction is fabricated as a belt comprising two fabric layers arranged in face-to-face relationship, and being interconnected to each other at spaced transverse locations therealong to define pockets to receive said weights.

6. A counterweight system according to claim 1, wherein said at least one flexible member of unitary construction comprises two layers of synthetic fabric material arranged in face-to-face relationship and interconnected at intervals therealong by transverse lines of stitching to define pockets to receive said weights, said weights being in the form of cylindrical rods of dense material.

7. A counterweight system according to claim 1, wherein said at least one flexible member of unitary construction comprises two layers of synthetic fabric material arranged in face-to-face relationship and interconnected at intervals therealong by transverse lines of stitching to define pockets to receive said weights, said weights being in the form of cylindrical rods of dense material, said rods having opposite end sections of enlarged diameter, spaced apart by a distance slightly greater than the transverse width of the belt.

8. A counterweight system according to claim 1, wherein said at least one flexible member of unitary construction comprises two layers of synthetic fabric material arranged in face-to-face relationship and interconnected at intervals therealong by transverse lines of stitching to define pockets to receive said weights, said weights being in the form of cylindrical rods of dense material, and further comprising a tube-like element of flexible material that is received over the carrier and weights combination and serves to prevent displacement of the weights from their pockets in the carrier.

9. A counterweight system according to claim 1, wherein said at least one flexible member of unitary construction is a flexible cord that is threaded through openings in said weights.

10. A counterweight system according to claim 1, wherein said at least one flexible member of unitary construction comprises a pair of spaced flexible cords threaded through apertures in opposite ends of said weights, and including spacer means on said cords adapted to maintain adjacent weights at a desired spacing.

11. A sectional door installation comprising: a door that is horizontally divided into a plurality of pivotally interconnected sections that have opposite ends guided in a pair of upright tracks positioned at opposite margins of a doorway, upper portions of said tracks being curved to extend horizontally away from said doorway such that when the door is moved from the closed position said sections follow in succession along the path of said tracks, said installation including a counterweight system comprising a continuous flexible elongate carrier having a series of weights spaced along its length, said weights being connected to the carrier and spaced from each other therealong by a distance such as to ensure that they do not prevent flexure of the carrier, the carrier having an upper end that is coupled to the door and a lower end connected to a fixed attachment point, the arrangement being such that when the door is in the closed position, substantially the entire weight of said series of weights is applied as a force urging the door in the opening direction, whereas when the door is moved in the opening direction said carrier moves downwardly under the force of gravity so that said weights are successively supported from the lower fixed attachment point and thus cease to apply any force to the door, said carrier being comprised of at least one flexible member of unitary construction which extends from said door to said point of fixed attachment.

12. A sectional door installation according to claim 11 including a casing attached adjacent the margin of the doorway and defining a vertically extending substantially enclosed channel to accommodate vertical movement of the carrier and weights during opening and closing movements of the door.

13. A sectional door installation according to claim 12 wherein one such flexible elongate carrier housed in a vertical casing is provided adjacent each vertical edge of the door.

14. A sectional door installation according to claim 13, wherein each carrier is connected to the bottom portion of the adjacent side of the door through a flexible cable that passes over a pulley mounted in the upper region of the doorway, balancing cables being provided and connected between each bottom side of the door and the opposite side carrier and weight assembly such that the counterweight force applied to the door is balanced from one side to the other thereof.

15. A sectional door installation according to claim 11, wherein the carrier is a flexible belt having pockets therealong to receive said weights.

16. A sectional door installation according to claim 11, wherein said at least one flexible member of unitary construction comprises an elongate belt fabricated from two superimposed layers of flexible fabric material stitched together transversely at spaced locations therealong to define pockets to receive said weights, said carrier having an extension beyond the region where said pockets are defined, and such extension being connectable at various points in its length to said fixed point of attachment.

17. A counterweight assembly for use in a sectional door installation wherein opposite ends of the door are guided in a pair of upright tracks positioned at opposite margins of a doorway, upper portions of said tracks being curved to extend horizontally away from said doorway such that when the door is moved from the closed position to the open position door sections follow in succession along the path of said tracks, said counterweight assembly comprising a flexible elongate carrier having a series of weights spaced at predetermined positions along its length, said weights being spaced from each other sufficiently so as not to prevent flexure of the carrier, the carrier having one end that is to be suspended from an element coupled to the lower part of the door and an opposite end for connection to a fixed attachment point, such that in use when the door is in the closed position, substantially the entire weight of said series of weights is applied and forces urging the door in that opening direction, wherein when the door is moved in the opening directions said one end of the carrier moves downwardly under the force of gravity so that through folding elements of said carrier commencing from said opposite end therein said weights become successfully supported from the fixed attachment point and thus cease to applying any force to the door, said carrier being comprised of at least one flexible member of unitary construction which extends from said element coupled to the lower part of the door to said fixed point of attachment.

18. A counterweight assembly according to claim 17 wherein the carrier is in the form of a belt having a series of pockets closely spaced therealong to receive said weights.

19. A counterweight assembly according to claim 17 wherein said weights extend over a length of the carrier that is about half the opening height of the door, the carrier having an unweighed extension at said opposite end thereof, and means for connection of said extension to the fixed point of attachment at different locations spaced along its length.

20. A counterweight assembly according to claim 17, wherein said at least one flexible member of unitary construction is fabricated as a belt comprising two fabric layers arranged in face-to-face relationship, and being interconnected to each other at spaced transverse locations therealong to define pockets to receive said weights.

21. A counterweight assembly according to claim 17, wherein said at least one flexible member of unitary construction is a flexible cord that is threaded through openings in said weights.

22. A counterweight assembly according to claim 17, wherein said at least one flexible member of unitary construction comprises a pair of spaced flexible cords threaded through apertures in opposite ends of said weights and including spacer means on said cords adapted to adjacent weights at a desired spacing.

* * * * *